US005190094A

United States Patent [19]

Knoess

[11] Patent Number: 5,190,094

[45] Date of Patent: Mar. 2, 1993

[54] HETEROPOROUS FORM TOOL FOR MANUFACTURING CASTING MOULDS AND PROCESS FOR ITS MANUFACTURE

[75] Inventor: Walter Knoess, Weissensee, Fed. Rep. of Germany

[73] Assignee: Sinterstahl GmbH, Fussen, Fed. Rep. of Germany

[21] Appl. No.: 381,658

[22] PCT Filed: Oct. 20, 1988

[86] PCT. No.: PCT/EP88/00942

§ 371 Date: Aug. 9, 1989

§ 102(e) Date: Aug. 9, 1989

[87] PCT Pub. No.: WO89/03736

PCT Pub. Date: May 5, 1989

[30] Foreign Application Priority Data

Oct. 22, 1987 [DE] Fed. Rep. of Germany ..... 3735751

[51] Int. Cl.[5] ..... B22C 7/00; B22C 23/00

[52] U.S. Cl. ..... 164/159; 164/228; 164/412; 264/44; 264/60; 264/122

[58] Field of Search ..... 164/159, 228, 412, 249; 264/44, 60, 122

[56] References Cited

U.S. PATENT DOCUMENTS

| | | | |
|---|---|---|---|
| 3,101,514 | 8/1963 | Callender et al. | 164/200 |
| 3,550,673 | 12/1970 | Gallagher et al. | 164/228 |
| 4,291,740 | 9/1981 | Michelson | 164/7.1 |
| 4,419,413 | 12/1983 | Ebihara | 164/412 X |

FOREIGN PATENT DOCUMENTS

| | | |
|---|---|---|
| 1026049 | 3/1958 | Fed. Rep. of Germany . |
| 1058226 | 5/1959 | Fed. Rep. of Germany . |
| 1070347 | 12/1959 | Fed. Rep. of Germany . |
| 2437328 | 2/1976 | Fed. Rep. of Germany . |
| 2403199 | 9/1978 | Fed. Rep. of Germany . |
| 3013659 | 10/1980 | Fed. Rep. of Germany . |
| 3002939 | 7/1981 | Fed. Rep. of Germany . |
| 3101236 | 1/1982 | Fed. Rep. of Germany . |
| 3039394 | 4/1987 | Fed. Rep. of Germany . |
| 1043174 | 9/1966 | United Kingdom . |

OTHER PUBLICATIONS

Michelson, Anatoly, New Market for Large, Complex Porous P/M Parts HPM Corporation, Mt. Gilead, Ohio 43338, USA, 1987.

Giesserei Lexikon, by E. Brunhuber (1986), pp. 650–651.

Rietzscher, "Filtrieren von Eisenschmelzen", Giesserei 72, No. 20, (1985), pp. 571–576.

*Primary Examiner*—J. Reed Batten, Jr.

*Attorney, Agent, or Firm*—Morgan & Finnegan

[57] ABSTRACT

A gas-permeable form tool for manufacturing casting and core moulds from hardenable moulding sand includes a heteroporous, open-pore material. The wall of the tool contains a first fine-pore layer region adjacent to the moulding sand with a thickness of about 0.2–2 mm and a material density of about 75% to 95% of theoretical specific density and a pore diameter of about 50 μm. The first fine-pore layer comes in contact with a second, large-pore supporting skeleton having a theoretical material density of less than 80% of theoretical specific density and a median pore diameter of more than 100 μm.

11 Claims, 1 Drawing Sheet

Figure 1:
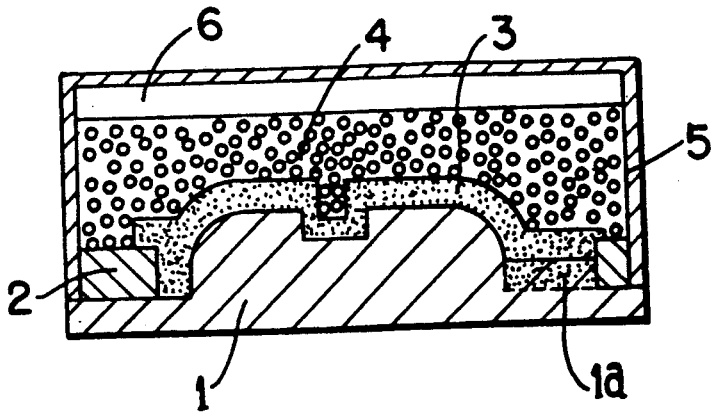

HETEROPOROUS FORM TOOL FOR MANUFACTURING CASTING MOULDS AND PROCESS FOR ITS MANUFACTURE

The invention relates to a gas-permeable form tool for manufacturing casting and core moulds from hardenable moulding sand and a process for its manufacture and an expedient application of such tool.

Casting moulds from moulding sand find wide-spread utilization in the manufacture of metal mould-mass produced parts. In the manufacture, only single-use, expendable massive or dish-shaped moulds are used. To manufacture the casting mould a fine-grain moulding sand is provided with hardenable bonding additives, conveyed over a sand intake to a form tool and hardened there. Hardening is performed thermally—at high energy costs—or, recently, alternatively also by means of reaction gases which are pressed under pressure through the mould sand in the form tool. In accordance with the latter variant, gas is compressed into the sand at the sand intake and must exit from the form tool through bores, jets or other channels and openings mechanically applied to the wall of the form tool.

Pursuant to an execution known in the art (DE 24 03 199, DE 30 39 394), bores in the wall of the form tool are sealed on the outside of the mould by high-pressure valves. Such form tools are disadvantageous because of their high tooling costs. The valves frequently become plugged up by grains of moulding sand entrained by gas and must be cleaned. Above all, however, the wall of the form tool displays no homogeneous gas permeability characteristics with the result that the reaction gases are unable to homogeneously permeate the moulding sand, and as a result, the moulding sand does not harden uniformly. Core moulds can only be manufactured on a massive scale.

DE 30 02 939 describes a form tool having a wall into which ribs and slits of varying dimensions have been mechanically placed. Reaction gas entering the moulding sand through an intake is sucked off through the slits.

The slits, however, fill up with sand. Moreover, manufacturing is quite expensive and does not permit fabrication of a truly fine-meshed network of slits and bores. In this execution of a form tool, too, sand is only unevenly permeated by the reaction gas. Additionally, excessive amounts of reaction gas are consumed, that is, in far greater amounts than are required according to the stoichiometry of the desired reaction.

Calls have already been made for the manufacturing of the form tool from porous and gas-permeable materials.

Transformation of this request into reality has heretofore been unsuccessful owing to the technical difficulties, which were to be expected, inherent in transforming complex geometries of casting moulds in a form tool made of porous materials as well as the requirement of ensuring homogenous gas-permeability of the wall in the micro-range as well as its mechanical stability and of assuring, at the same time, that the moulding sand, when pressure charged with reaction gas, does not block the form tool pores or even exit through the pores of the form tool wand.

The purpose of the present invention is the production of a form tool having a homogenous gas-permeable wall even in micro areas. The aforementioned known methods and techniques are not suitable for doing this.

More specifically, the purpose of the invention is to produce a heteroporous form tool by combining known techniques for the production of porous materials so that the form tool has adequate microporosity in the first region adjacent to the form and has a large porous supporting skeleton in the region adjacent to the first region. A form tool of this sort is suited to the production of casting moulds of forms in great numbers, particularly the production of non-massive casting moulds in the forms of shells. In accordance with this purpose, the surface of the form tool which comes in contact with the form sand has to be especially wear-resistant The blocking of pores by this form sand will no longer cause the form tool to fail. Pores which become blocked by form sand can now be regenerated, easily clearing and reopening the pores.

The task of devising a gas-permeable form tool is resolved by the invention in that the tool consists of heteroporous, open-pore material, whereby the wall of the form tool exhibits an initial fine-pore layer region adjacent to the moulding sand 0.2–2 mm thick, having a material density between about 75 to 95% of the theoretical specific density and pore diameter $<50$ μm and which comes in direct contact with a second, large-pore supporting skeleton having a material density less than about 80% of the theoretical specific density, and a median pore diameter $>100$ μm. Executions according to other aspects of this invention 10 have shown themselves to be particularly expedient for the gas-permeable form tool and process for its manufacture and advantageous application.

Casting and core moulds, that is, moulds for the production of massive as well as internally hollow casting parts form a part of form tools.

To achieve the required material and structural characteristics of the form tool wall according to the present invention, the usual technical expert has a number of individual processes at his disposal for the manufacture of porous tools, which processes should be advantageously combined.

Metallic and/or ceramic materials and/or plastics are the basic materials used for the form tool wall. In a single form tool according to designs known in the art, up to 60,000 sand moulds are manufactured according to size. For reasons of economy, the sand is poured into the mould at high speed and under high pressure. Wear and tear to the surface of the form tool coming in contact with moulding sand is commensurately high. This situation must be taken into consideration in the choice of the material of the fine-pored layer of the form tool. Wear-resistant types of steel as well as wear-resistant ceramics and metallic and non-metallic hard materials, e.g., silicon nitride, boron nitride, titanium carbide, titanium nitride, silicon carbide, have proved useful for this layer.

The heteroporous wall of the form tool can be formed from either viscous, effervesced and subsequently solidified material, or the wall is moulded by means of powdery raw materials subsequently solidified.

The layer of the wall of the form tool which comes into contact with the moulding sand can be formed by compressing powder isostatically on a gauge mould according to the casting part. The powder can, having been mixed with a volatile solvent, be applied as a paste to the gauge mould or sprayed thereon. Galvanic processes and gas precipitation processes (PVD processes) have shown themselves to be useful in forming said layers. Finally, the layer can be applied to the gauge mould in the form of a flexible metallic or ceramic film, foil or thin sheet ("films"). The flexibility of such films is provided by extremely flexible thermoplastic components which, when solid, evaporate during subsequent heat treatment Films can also, moreover, consists of powdery metals, hard materials or ceramics.

The gauge mould to which the layer material has been applied is thereupon either foamed up or, following embedding in a corresponding outer mould, filled with coarse-grained powdery material and, preferably, isostatically compressed.

The finished compound body is produced by thermal or chemical hardening, burning or sintering of the compacted compound materials.

In the manufacture of the open-pore supporting skeleton, it has shown itself to be expedient to coat sand, glass or ceramic grains first with a thin plastic coating through dipping in corresponding dispersions or solutions.

Granulate so pretreated can be poured and/or compressed into a mould and subsequently chemically or thermally hardened.

Techniques to obtain fine-pore or large-pore and open-pore materials are known in the art. Thus, for example, in the manufacture of diaphragms for electrodes in electro-chemistry techniques utilizing special pore forming agents have been developed which produce a material structure of a defined gas-permeability of the kind required in the present case. Techniques for the manufacture of coarse- and open-pore materials have been developed in the broad applications field of mechanical filters as, for example, in the field of self-lubricating friction bearings or electrical contact materials consisting of porous skeleton of a material A into which material B is infiltrated.

Form tools in accordance with the present invention display a multiplicity of advantages. They exhibit an open-pore wall construction with a defined drop in pressure which is completely homogeneous through to the micro-region. The pressure drop enables uniform gas permeation through the wall and, consequently, homogeneous hardening of the moulding sand. The pores in the fine-pore region of the wall of the form tool are composed in such a way that only in extraordinary circumstances are grains of sand able to accumulate in the wall of the form tool. Of decisive importance, however, is the fact that these grains of sand can, as a rule, be removed again from the pores with little effort by blowing air under high pressure, possibly together with solvent damping down, from the direction of the coarse-pore skeleton of the wall of the form tool through the fine-pore wall layer.

In contrast to processes known in the art whereby gas hardening of the moulding sand is accomplished by blowing in gas via the sand intake, pressurization of the moulding sand confined in the form tool can, where form tools according to the invention are used, be accomplished through the heteroporous wall. By correspondingly regulating gas pressure and time it is possible to effect hardening of the confined moulding sand only in a marginal area up to a desired depth. More precise dosaging can be achieved by saturating the form tool with a suitable liquid. By so doing, a specific capillary pressure is created in the fine pores of the wall of the tools which releases the reaction gas only when this pressure is exceeded. The core of the confined sand, given corresponding stoichiometric dosage of the gas, remains friable and, following hardening of the marginal area, can be removed via the sand intake and recycled.

An intrinsic advantage of form tools according to the present invention lies in the possibility of adapting their surface facing the moulding sand to the desired casting mould and of configuring their rear surface, however, with few plane surfaces, e.g., square-shaped or cylindrical. Owing to the gas-induced pressurization of the moulding sand through the porous wall of the form tool a fine layer of gas regularly forms between the wall of the form tool and the moulding sand, thereby precluding adherence of the moulding sand to the form tools wall during the sand hardening process. The sand mould is easily detached from the form tool following the hardening process. Special measures to prevent the adherence of moulding sand and the form tool (spraying of the form tool wall, insertion of a film), as are required with tools and processes for the manufacture of casting moulds known in the art, can, as a rule, be omitted. The technique of subsequent applications of a fine-pore layer and skeleton materials to the gauge mould makes it possible to give the form tool directly its definitive shape, surface characteristics and wear-resistance qualities. Consequently, neither a cost-intensive mechanical finishing of the surface of the wall of the form tool to produce the desired geometry and surface roughness is necessary nor is re-treatment, in particular, thermal hardening processes, to achieve requisite surface hardness and resistance to wear—in contrast to processes heretofore utilized in manufacturing form tools which do not start off with porous materials.

The invention is described in more detail by means of FIG. 1 as well as two practical embodiments.

FIG. 1 shows the shape of a half-shell of a form tool, in a sectional view, as well as devices for the manufacture of the form tool according to a preferred process. The sectional view provided by FIG. 1 shows, in particular, the match plate 1 together with the gauge mould for the half-shell of a form tool. In the sectional view that region of the match plate is particularly marked which, during later use, provides the sand intake of the form tool 1*a*. A sealing plate 2 bears on the match plate or is screwed or clamped thereto. It has a central recess corresponding to the geometric form of the form tool to be produced. The fine-pore layer region 3 of the form tool adjacent to the moulding sand displays a constant layer thickness over the entire surface area, except for a narrow region at the dividing surface of both half-shells. The open pore supporting skeleton 4 is in direct contact with the fine-pore layer region of the form tool. The outer geometric shape of the form tool is provided by a moulding box 5 or frame which has been screwed onto the match plate. Manufacturing variants are possible in this configuration whereby the moulding box is not completely filled up with the material but, rather, whereby, during the filling up with a material which can flow or be coated, an air space 6 remains between the supporting skeleton and the top of the moulding box.

EXAMPLE 1

According to the technique shown in FIG. 1 (for the manufacture of the form tool), first a match plate with the gauge mould of a half of the casting part to be manufactured is produced according to standard procedures from a metallic and/or ceramic material or plastic. In the majority of cases it is best, with core and casting moulds, to manufacture the form tool from two half-shells. After previously applying a separating compound, a sealing plate, preferably made of steel or ceramic, is applied to the match plate and connected by screws to the match plate. The central recess in the sealing plate is dimensioned in such a way that in the region of the dividing surface of both half-shells of the form tool between the gauge surface (match plate) and sealing plate, a clearance of the thickness of the fine-pore layer region of the form tool remains.

The fine-pore layer of the form tool is first applied to the gauge surface of the match plate—if necessary, following prior application of a separating compound to the gauge surface. A paste is brushed on or sprayed on for this purpose. The paste consists of fine-grained, corrosion-resistant ceramic powder whose grain size is, on the average, 10—100 μm thick, to which powder, in order to increase form tool surface wear resistance, 10–20% volume of titanium carbide powder (measured proportionate that amount of ceramic powder) having the approximate same size of grains is added. The powder is worked up to a paste using a volatile, thermally evaporable bonding agent. To the bonding agent, where necessary, non-volatizing metallic and/or non-metallic components and/or pore forming agents have been added. Application of the fine-pore layer is preferably performed in several layers until the desired overal layer thickness has been achieved In the process, the layer application according to FIG. 1 also is performed beyond the edge of the sealing plate.

The fine-pore layer applied in this manner is dried or hardened. Subsequent thereto, a moulding box or moulding frame as per FIG. 1 is screwed onto the match plate or sealing plate and the material used to form the wall area with the open-pore skeleton is placed into the moulding box. For this purpose, a coarse-grain ceramic powder to which volatile pore forming materials have been added, is used. Such materials are of the type used to manufacture porous ceramic filters, for example. The ceramic powder is stirred together with volatile bonding agents to form a paste which is coated on to the moulding box and allowed to harden thereon. Thereafter the form tool is separated from the match plate and sintered or burned in high-temperature ovens. In this manner one obtains wear-resistant, ready-to-assemble form tool half-shells with plane separating surfaces. The mould surface, as a rule, does not require any surface refinishing. The area of the sand intake is finally sealed off with a pore filler so that during future operation no reaction gas can penetrate through this area of the form tool wall and so that the moulding sand cannot harden in this area.

Inspection of form tools manufactured in this way with the wall construction according to the invention has shown that a 1–2 bar differential pressure can be created at the boundary between the coarse- and fine-layer. The resulting range of variation of the absolute gas pressure before the boundary in the coarse-pore section of the wall in varying sections of the wall of the form tool or in various form tools manufactured according to the same process lies between 0.1–0.2 bar and is, therefore, to a great extent independent of the actual thickness of the coarse-pore supporting skeleton of the wall of the form tool. The aforementioned jump in the gas pressure at the boundary between the coarse- and fine-pore layer occurs practically speaking solely on account of the structure of the fine-pore layer. This pressure jump can be maintained further by saturating the form tool with a suitable sealing liquid whereby a very homogeneous capillary pressure is formed over the entire surface area of the form tool in the pores of the fine-pore layer.

The manufacture of a casting mould from moulding sand using a form tool according to the present invention proceeds as follows. After having been filled with moulding sand, the form tool is charged externally with reaction gas having a pressure of >2 bar. This gas forces the liquid out of the capillaries of the fine-pore layer of the form tool and, at a gas pressure which can be precisely regulated, reaches the moulding sand or a marginal area of the sand mould That enables the moulding sand to be hardened to the desired, easily regulatable depth. The core region of the moulding sand poured in continues to be friable and, following conclusion of the hardening process, can be removed via the sand intake and recycled. When gas pressure falls below 2 bar, the sealing liquid, by the wick effect, is drawn back again into the pores of the fine-pore layer. That means short fabrication times for the individual sand moulds as well as low susceptibility to trouble and low scrap levels.

EXAMPLE 2

Analogous to Example 1, a gauge mould or match plate for a form tool is manufactured. Also as in Example 1 a sealing plate is clamped onto the match plate. The form tool wall material for the fine-pore layer is applied to the gauge mould in the form of a flexible metallic film The separately fabricated metallic film consists of a homogeneous mixture of corrosion-resistant steel particles with a grain size distribution varying from 10–100 μm, where necessary, enriched with some percent per volume of wear-resistant titanium carbide particles of comparable grain size, where necessary, supplemented by powdery fillers and pore-forming materials as well as of a thermoplastic plastic which is volatilized at higher temperatures. By means of techniques known in the art for isostatic powder-tube compression, a rubber or plastic "tube" is thereupon clamped onto the base of the match plate and filled with a coarse-grain powder mixture consisting of alloyed iron powder and pore-forming agents —covering over the fine-pore layer. The inside of the tube is thereupon evacuated, the tube sealed off. The entire unit is cold-isotatically compacted. The unfinished cast of the form tool is separated from the match plate and further processed using standard sintering processes. The sintered form tool can—to the extent necessary—be mechanically machined and, for example, sized for mounting in tool mounting supports.

It is customary, during the isostatic powder compaction in plastic or rubber sheaths, to give the rubber sheath the rough form or rough contours of the form piece to be compacted. Accordingly, with respect to the case at hand, half-shells of form tools having an approximately homogeneous form tool wall thickness can be achieved.

As already mentioned hereinbefore, a multiplicity of techniques, commensurate with the broad applications filed for porous moulded bodies, is known in the art for producing fine-pore and/or large-pore moulded bodies from powdery materials. The description for the manufacture of form tools is provided with reference to those product groups and is not intended to be in any way definitive

I claim:

1. A gas-permeable form tool for manufacturing casting and core moulds from hardenable moulding sand, the form tool comprising heteroporous, open-pore material, said form tool having a heteroporous wall including a first fine-pore layer region adjacent to a moulding sand to be conveyed to said form tool and hardened, by blowing reaction gas towards said moulding sand through said heteroporous wall, said first fine-pore layer being about 0.2–2 mm thick and having a material density between about 75 to 95 percent of theoretical specific density and a pore diameter of less than about 50 μm, said first fine-pore layer being in contact with a second large-pore supporting skeleton having a theoretical material density of less than 80 percent of theoretical specific density and a median pore diameter of more than about 100 μm, the boundary between said first fine-pore layer and said second large-pore layer providing a differential pressure when said form tool is charged externally with said reaction gas.

2. A form tool according to claim 1, wherein the material is an open-pore, solidified foam.

3. A form tool according to claim 1, wherein the tool comprises a ceramic material.

4. A form tool according to claim 1, wherein the tool comprises a metallic material.

5. A form tool according to claims 1, 2, 3 or 4 wherein at least one of the regions comprises at least two layers of homogeneous structure and material composition.

6. A form tool according to claim 5 wherein the wall regions of different pore thickness comprise different materials.

7. A form tool according to claim 5 wherein inner surface of said tool is shaped to produce a complex geometry of the casting mould desired and the outer surface of said tool includes a plane surface.

8. A form tool according to claim 5 wherein the form tool comprises two or more parts.

9. A process for manufacturing a form tool to be used for manufacturing a casting mould, said form tool having a heteroporous wall, comprising the following steps:

applying a first layer of a fine-grain powdered first material to a gauge mould of said casting mould said first layer being about 0.2–2 mm thick and having a material density between about 75 to 95 percent of theoretical specific density and a pore diameter of less than about 50 um;

applying by compression a coarse-grain powdered second layer as supporting skeleton having a theoretical material density of less than 80 percent of theoretical specific density and a median pore diameter of more than about 100 um, said first layer being in contact with said second layer; and setting the wall of the form tool.

10. A process for manufacturing a form tool as in claim 9 wherein a pore-forming agent is added to at least one of the powdered materials prior to application of the materials.

11. A process for manufacturing a form tool according to claim 10 wherein setting of the form tool is accomplished by sintering.

* * * * *

UNITED STATES PATENT AND TRADEMARK OFFICE

CERTIFICATE OF CORRECTION

PATENT NO. : 5,190,094

DATED : March 2, 1993

INVENTOR(S) : Walter Knoess

It is certified that error appears in the above-identified patent and that said Letters Patent is hereby corrected as shown below:

Claim 9, Column 8, lines 18 and 23, change "um" to --μm--.

Signed and Sealed this

Thirtieth Day of November, 1993

*Attest:*

*Attesting Officer*

BRUCE LEHMAN

*Commissioner of Patents and Trademarks*